US007822358B2

(12) United States Patent
Imada et al.

(10) Patent No.: US 7,822,358 B2
(45) **Date of Patent: *Oct. 26, 2010**

(54) IMAGE FORMING DEVICE WITH IMAGE READING SECTION SUPPORTING BODY

(75) Inventors: Takanoshin Imada, Iwatsuki (JP); Yuichi Fujisawa, Iwatsuki (JP); Masashi Sudo, Iwatsuki (JP); Junichi Yumoto, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1178 days.

This patent is subject to a terminal disclaimer.

(21) Appl. No.: 11/199,141

(22) Filed: Aug. 9, 2005

(65) Prior Publication Data

US 2006/0182462 A1 Aug. 17, 2006

(30) Foreign Application Priority Data

Feb. 15, 2005 (JP) ..... 2005-037597

(51) Int. Cl.
*G03G 15/00* (2006.01)

(52) U.S. Cl. ..... 399/107; 399/118; 347/138; 347/242

(58) Field of Classification Search ..... 399/107, 399/118; 347/138, 242
See application file for complete search history.

(56) References Cited

U.S. PATENT DOCUMENTS

| | | | | |
|---|---|---|---|---|
| 5,920,758 | A | 7/1999 | Ohtsuki | |
| 6,112,040 | A | 8/2000 | Saito et al. | |
| 6,466,753 | B2 * | 10/2002 | Kida | 399/107 |
| 7,463,842 | B2 * | 12/2008 | Imada et al. | 399/92 |
| 7,515,864 | B2 * | 4/2009 | Imada et al. | 399/377 |
| 2004/0096237 | A1 * | 5/2004 | Asai | 399/107 |
| 2005/0196192 | A1 * | 9/2005 | Morimoto et al. | 399/107 |

(Continued)

FOREIGN PATENT DOCUMENTS

| | | |
|---|---|---|
| CN | 1205458 | 1/1999 |

(Continued)

OTHER PUBLICATIONS

Chinese Office Action, dated Aug. 10, 2007, for Application No. 200510102736.0.

(Continued)

*Primary Examiner*—David P Porta
*Assistant Examiner*—Bryan P Ready
(74) *Attorney, Agent, or Firm*—Sughrue Mion, PLLC

(57) ABSTRACT

An image forming device having an image reading section which is supported in a cantilevered state with a space between the image reading section and a top surface of an image forming section, the image forming device including: a housing of the image forming section; and a first supporting body fixed to a side surface of the housing and supporting the image reading section, wherein the first supporting body has: a first supporting portion fixed to the side surface of the housing and supporting the image reading section; and a second supporting portion extending from the first supporting portion in a same direction as the image reading section which is supported in the cantilevered state, and a receiving portion, which fixes the second supporting portion, and is provided at the side surface of the housing.

18 Claims, 15 Drawing Sheets

U.S. PATENT DOCUMENTS

2006/0056875 A1 3/2006 Karasawa et al.

FOREIGN PATENT DOCUMENTS

| | | | |
|---|---|---|---|
| JP | 2001326770 | | 12/1899 |
| JP | 4-6047 | U | 1/1992 |
| JP | 05-219308 | | 8/1993 |
| JP | 11-122406 | | 4/1999 |
| JP | 2001034141 | | 2/2001 |
| JP | 2001-203840 | A | 7/2001 |
| JP | 200123600 | | 8/2001 |
| JP | 2001-326770 | A | 11/2001 |
| JP | 2002323802 | | 11/2002 |
| JP | 2003202791 | A | 7/2003 |
| JP | 2003298792 | | 10/2003 |
| JP | 2004109723 | A | 4/2008 |
| JP | 2001203840 | | 7/2010 |
| KR | 2004-0085184 | | 12/1899 |
| WO | 03069415 | | 8/2003 |

OTHER PUBLICATIONS

Chinese Office Action, dated Nov. 23, 2007, for Application No. 200510102604.8.

Korean Office Action, dated Aug. 30, 2006, for Application No. 10-2005-0082079.

Final Office Action for U.S. Appl. No. 11/202,137, dated Feb. 26, 2008.

Non-Final Office Action for U.S. Appl. No. 11/202,137, dated Aug. 17, 2007.

Non-Final Office Action for U.S. Appl. No. 11/213,697, dated Jun. 25, 2008.

Non-Final Office Action for U.S. Appl. No. 11/213,697, dated Nov. 27, 2007.

Japanese Office Action corresponding to JP Application No. 2005-037597, dated Aug. 10, 2010.

* cited by examiner 600
602
604
604A
610
612
614
C
C

IMAGE FORMING DEVICE WITH IMAGE READING SECTION SUPPORTING BODY

CROSS-REFERENCE TO RELATED APPLICATION

This application claims priority under 35 USC 119 from Japanese Patent Application No. 2005-037597, the disclosure of which is incorporated by reference herein.

BACKGROUND OF THE INVENTION

1. Field of the Invention

The present invention relates to an image forming device.

2. Description of the Related Art

There are image forming devices in which an image forming unit is disposed on the top surface of a sheet feeding unit, and an image reading unit is disposed above the image forming unit. Further, a structure in which a supporting body, which supports the image reading unit, is fixed to the rear surface of the sheet feeding unit has been proposed.

In such a structure, as the image forming unit and the sheet feeding unit move, the image reading unit, which is supported at the supporting body, can also move integrally. Further, in this structure, because the sheet feeding unit is positioned at the lowermost portion of the image forming device and accommodates sheets in the interior thereof, the sheet feeding unit is sufficiently heavier than the image reading unit. Accordingly, the image reading unit is, via the supporting body, in a stable state. Moreover, because the weight of the image forming unit and the sheet feeding unit is not applied to the supporting body, it suffices for the supporting body to have strength that supports only the weight of the image reading unit. Accordingly, the structure of the supporting body can be made to be simple. (Refer to, for example, Japanese Patent Application Laid-Open (JP-A) No. 2001-203840.)

However, when such a supporting body is fixed to a side surface of the housing of the image forming unit in order to form a simpler structure, the housing warps due to the weight of the image reading unit, and problems arise in that the quality of the image formed on the sheet at the image forming unit deteriorates, the positions of the sheet and the image formed on the sheet are offset, and the like.

SUMMARY OF THE INVENTION

The present invention was developed in order to overcome the above-described problems, and provides an image forming device in which a supporting body, which supports an image reading section, can be fixed to a side surface of a housing of an image forming section, such that the image reading section is disposed in a cantilevered state with a space between the image reading section and the top surface of the image forming section, by a more simple structure than the prior art.

A first aspect of the present invention is an image forming device having an image reading section which is disposed with a space between the image reading section and a top surface of an image forming section and is supported in a cantilevered state, the image forming device comprising: a housing of the image forming section; and a first supporting body fixed to a side surface of the housing and supporting the image reading section, wherein the first supporting body has: a first supporting portion fixed to the side surface of the housing and supporting the image reading section; and a second supporting portion extending from the first supporting portion in a same direction as the image reading section which is supported in the cantilevered state, and a receiving portion, which fixes the second supporting portion, is provided at the side surface of the housing.

In the image forming device based on the present aspect, the first supporting body, which supports the image reading section, is fixed to a side surface of the housing of the image forming section. The first supporting body has a first supporting portion, which supports the image reading section and is fixed to the side surface of the housing, and a second supporting portion, which extends from the first supporting portion in the same direction as the image reading section which is supported in the cantilevered state. Further, a receiving portion, which fixes the second supporting portion, is provided at the side surface of the housing.

Accordingly, at the side surface of the housing, even if force is applied to a triangular region structured by the first supporting portion and the second supporting portion, and force is applied in a direction in which the first supporting body falls over, the receiving portion receives the second supporting portion. Accordingly, even though the first supporting body, which supports the image reading section, is fixed to the side surface of the housing of the image forming section, it is difficult for the side surface of the housing to warp.

In this way, it is difficult for the side surface of the housing to warp even though the first supporting body, which supports the image reading section, is fixed to the side surface of the housing of the image forming section. Therefore, with an even simpler structure, the image reading section can be disposed in a cantilevered state with a space between the image reading section and the top surface of the image forming section. Due to the second supporting portion extending in a substantially horizontal direction from the first supporting portion, even if force is applied in the direction in which the first supporting body falls over, warping of the housing is suppressed and the image reading section can be supported securely.

In a second aspect of the present invention, the receiving portion is a frame which is fixed to the side surface of the housing and stands erect from the side surface, and the second supporting portion is fixed to the frame.

In the image forming device based on the present aspect, the second supporting portion is fixed to the frame which is fixed to the side surface of the housing and stands erect from the side surface. Accordingly, the frame also is integral with the first supporting body, and supports the image reading section.

Accordingly, at the side surface of the housing, force is applied to the region of the frame, in addition to the substantially triangular region structured by the first supporting portion and the second supporting portion. Therefore, the image reading section can be fixed even more securely, and it is even more difficult for the side surface of the housing to warp.

In a third aspect of the present invention, the first supporting portion of the first supporting body is shaped as a hollow tube whose axial direction is a vertical direction.

The first supporting portion of the first supporting body of the image forming device based on the present aspect is shaped as a hollow tube whose axial direction is the vertical direction. Accordingly, the first supporting portion can more strongly support load.

In a fourth aspect of the present invention, a pair of the side surfaces are provided so as to oppose one another, the first supporting bodies are fixed to the side surfaces respectively, and sizes of horizontal cross-sections of the first supporting portions, which are shaped as hollow tubes, are different at one side and another side.

In accordance with the present aspect, the size of the horizontal cross-section of the hollow, tube-shaped first supporting portion of the first supporting body can be selected appropriately. Space can thereby be conserved.

In a fifth aspect of the present invention, a pair of the side surfaces are provided so as to oppose one another, the first supporting body is fixed to one of the side surfaces, and a second supporting body, whose shape is different than a shape of the first supporting body and which supports the image reading section, is fixed to another of the side surfaces.

In the present aspect, because the first supporting body is fixed securely to the side surface, much of the weight of the image reading section can be supported by only the first supporting body. Therefore, the second supporting body, which is fixed to the other side surface, does not have to be fixed as securely as the first supporting body. Namely, the second supporting body may be an arbitrary shape. Accordingly, the degrees of freedom in design are further increased.

In a sixth aspect of the present invention, the second supporting body is shaped as a hollow tube whose axial direction is a vertical direction.

In the present aspect, the second supporting body is shaped as a hollow tube whose axial direction is the vertical direction. Accordingly, the second supporting body can more strongly support load.

In a seventh aspect of the present invention, the first supporting portion of the first supporting body is shaped as a hollow tube whose axial direction is the vertical direction, and sizes of a horizontal cross-section of the first supporting portion, which is shaped as a hollow tube, of the first supporting body, and a horizontal cross-section of the second supporting body, which is shaped as a hollow tube, are different.

In accordance with the present aspect, the sizes of the horizontal cross-section of the hollow, tube-shaped first supporting portion of the first supporting body and the horizontal cross-section of the hollow, tube-shaped second supporting body can be selected appropriately. Space can thereby be conserved.

In an eighth aspect of the present invention, among the pair of side surfaces which oppose one another, the first supporting body is fixed to the side surface which is nearer to a center of gravity of the image reading section.

In the present aspect, by fixing the first supporting body, which is securely fixed, to the side surface which is nearer to the center of gravity of the image reading section, the burden on the second supporting body is reduced, and the degrees of freedom in design are improved accordingly.

In a ninth aspect of the present invention, a driving mechanism is mounted to either one of the pair of side surfaces which oppose one another, and the first supporting body is fixed to the one side surface to which the driving mechanism is mounted.

In the present aspect, the driving mechanism is fixed to either one of the pair of side surfaces which oppose one another. The driving mechanism generates vibrations at the time of driving. Accordingly, by fixing the first supporting body, which is securely fixed, to the one side surface to which the driving mechanism is fixed, the burden on the second supporting body is reduced, and the degrees of freedom in design are improved even more.

In a tenth aspect of the present invention, an electric wire, which electrically connects the image reading section and the image forming section, is attached to either one of or to both of the first supporting body and the second supporting body.

In the present aspect, the electric wire, which electrically connects the image reading section and the image forming section, is attached to either one of or to both of the first supporting body and the second supporting body. Accordingly, there is no need to particularly provide space for laying of the electric wire, and space can be conserved.

In an eleventh aspect of the present invention, an interlocking mechanism of the image forming section is attached to either one of or to both of the first supporting body and the second supporting body.

In the present aspect, the interlocking mechanism of the image forming section is attached to either one of or to both of the first supporting body and the second supporting body. Accordingly, there is no need to separately provide space for attaching the interlocking mechanism. Because the interlocking mechanism is attached to the side surface of the housing, it coexists with the first supporting body and the second supporting body. Accordingly, space can be conserved.

The interlocking mechanism is a mechanism which effects control such that, only in a case in which a given process is in a correct state, another process operates. In other words, the interlocking mechanism is a mechanism for preventing trouble which occurs due to erroneous operation or malfunctioning of machinery. For example, the interlocking mechanism may be a mechanism which senses the open/closed state of an opening/closing cover and does not permit operation of the device if the opening/closing cover is open, because problems will arise if the device operates when the opening/closing cover is open.

In a twelfth aspect of the present invention, either one of or both of the second supporting body and the first supporting portion of the first supporting body is structured by a plurality of metal plates being superposed together, and the metal plates are bent and form a hollow rectangular pillar portion whose axial direction is a vertical direction.

In the present aspect, the metal plates of either one of or both of the second supporting body and the first supporting portion of the first supporting body, are bent and form a hollow rectangular pillar portion whose axial direction is the vertical direction. Accordingly, the second supporting body and/or the first supporting portion of the first supporting body can more strongly support load.

As described above, in accordance with the present invention, even though the first supporting body, which supports the image reading section, is fixed to the side surface of the housing of the image forming section, it is difficult for the side surface to warp. Therefore, by an even simpler structure, the image reading section can be disposed in a cantilevered state with a space between the image reading section and the top surface of the image forming section.

DETAILED DESCRIPTION OF THE INVENTION

Figure 1:
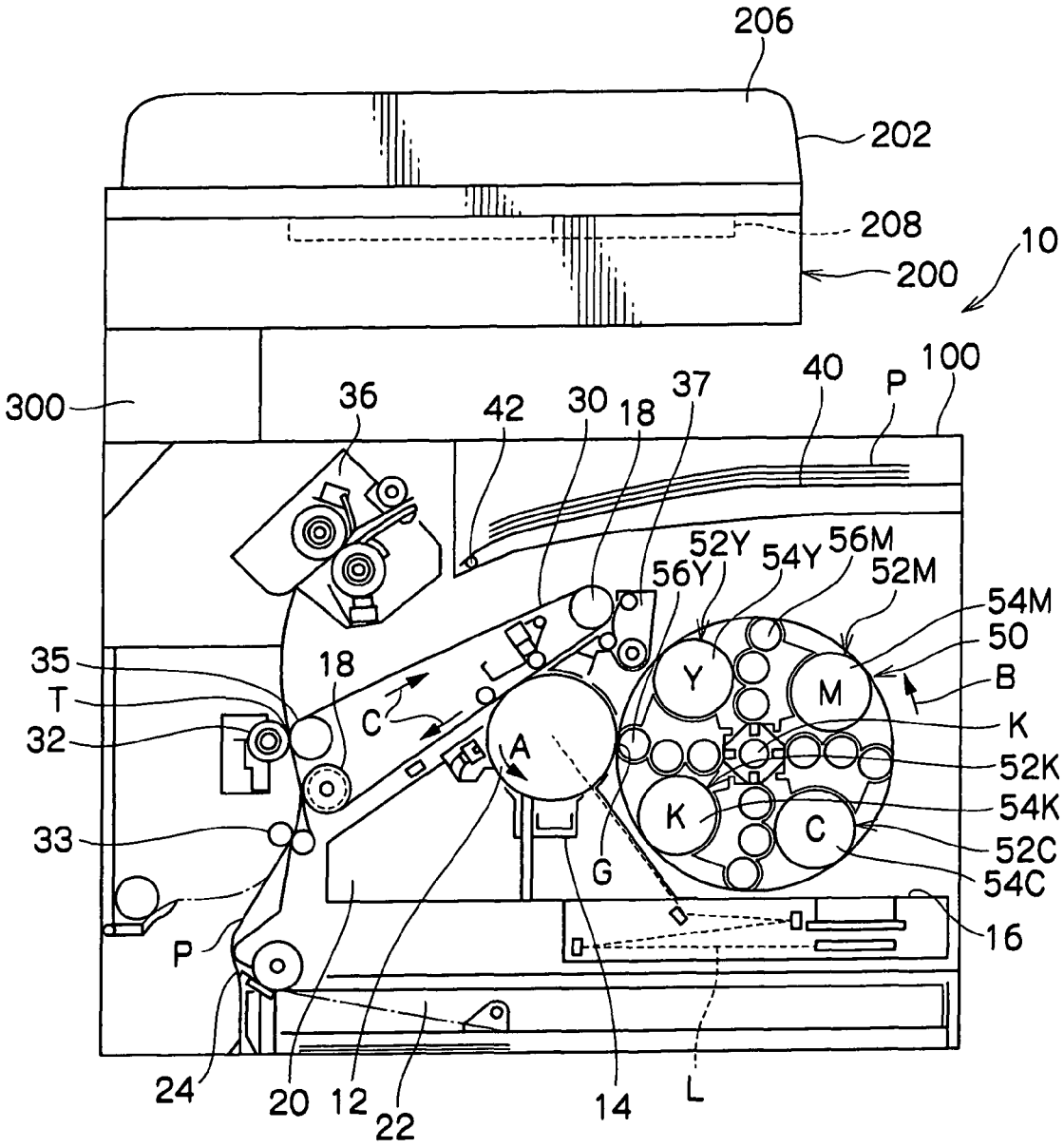
FIG. 1 is a drawing schematically showing a digital copier relating to an embodiment of the present invention.
Figure 3:
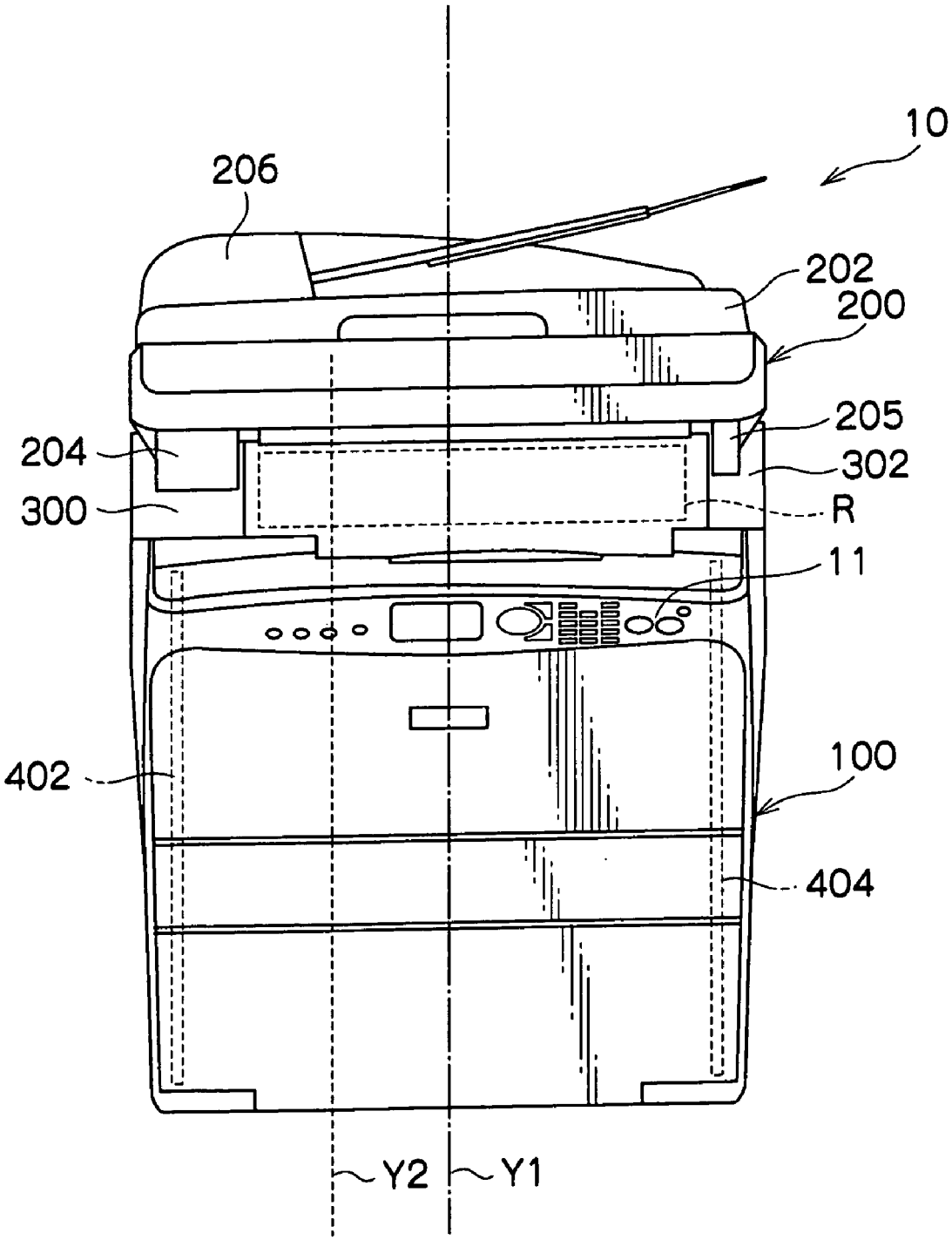
FIG. 3 is a drawing of the digital copier as seen from a front surface.

As shown in FIGS. 1 and 3, a digital copier 10, which is an example of an image forming device of an embodiment of the present invention, is structured such that an image reading section 200 is disposed in a cantilevered state with a space between the image reading section 200 and a sheet discharge tray 40 which is the top surface of an image forming section 100. The image reading section 200 reads a document, and converts it into digital image data.

On the basis of the digital image data read at the image reading section 200, the image forming section 100 forms a full-color image on a recording sheet P by a known electrophotographic process by using toners of the respective colors of magenta (M), yellow (Y), cyan (C), and black (K). Further, an operation panel 11 side, which is shown in FIG. 3 and at which a user carries out various types of operations, is the front surface side, and the opposite side is the rear side.

First, the image reading section 200 will be explained.

Figure 2:
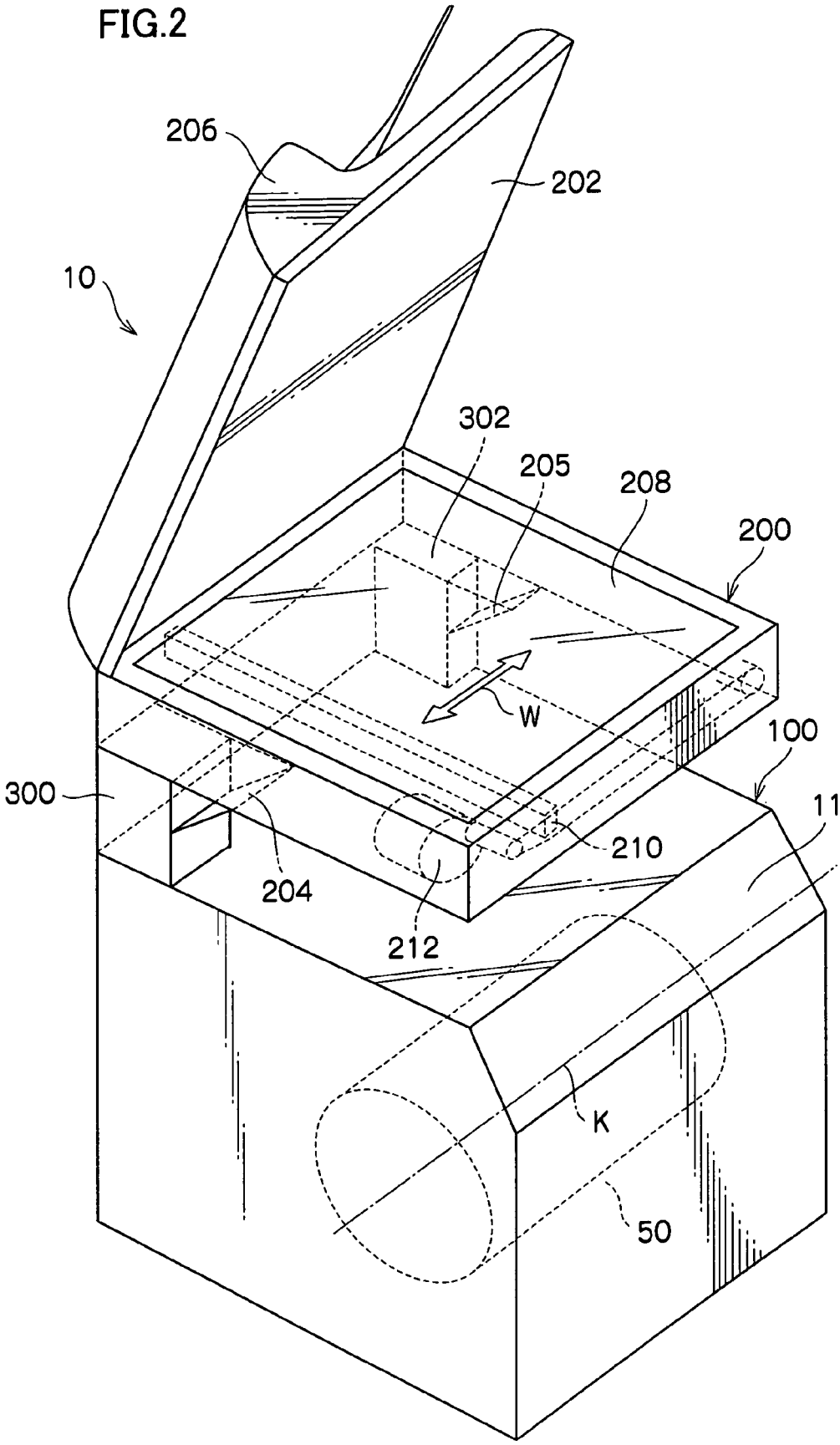
FIG. 2 is a perspective view schematically showing a state in which a presser plate of an image reading section of the digital copier is open.

As shown in FIGS. 2 and 3, the image reading section 200 has a substantially quadrilateral configuration as seen in plan view. The two corner portions at the rear side are mounted on a first supporting pillar portion 300 and a second supporting pillar portion 302 which stand erect at the corner portions of the rear side of the image forming section 100.

As shown in FIG. 2, a presser plate 202 at the upper portion of the image reading section 200 is rotated and opened. A document stand 208, which is transparent and is formed from a platen glass or the like and on whose top surface a document is placed, is provided beneath the presser plate 202. An automatic document feed device 206 is provided at the upper portion of the presser plate 202. A reading bar 210, which is formed by a CCD or the like and which reads the document placed on the document stand 208, is provided beneath the document stand 208. The reading bar 210 is long and narrow from the front surface side to the rear side. The reading bar 210 is scanned in the directions of arrow W by a scanning driving mechanism 212, so as to read the image of the document placed on the document stand 208.

Figure 4:
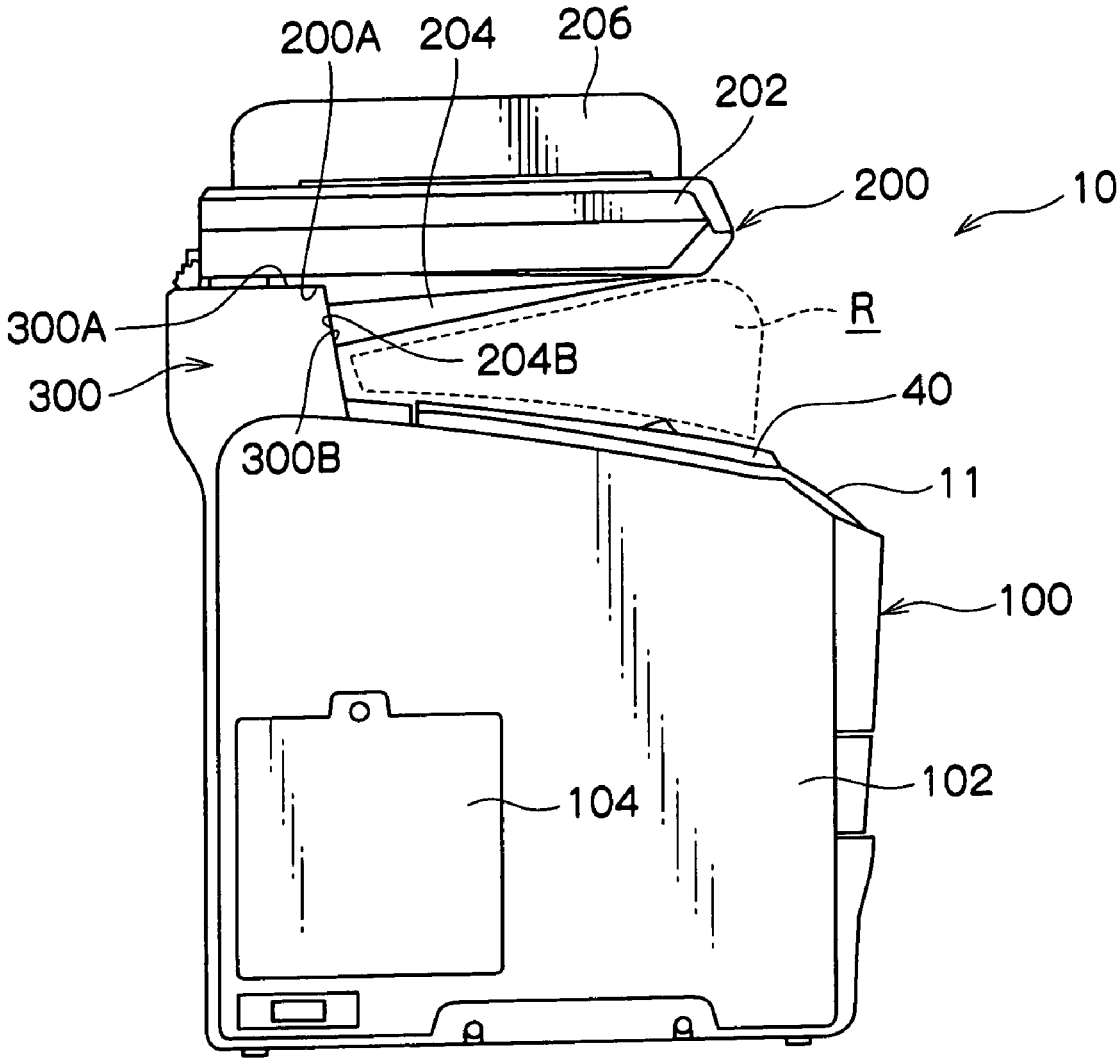
FIG. 4 is a drawing of the digital copier as seen from a side surface.
Figure 5:
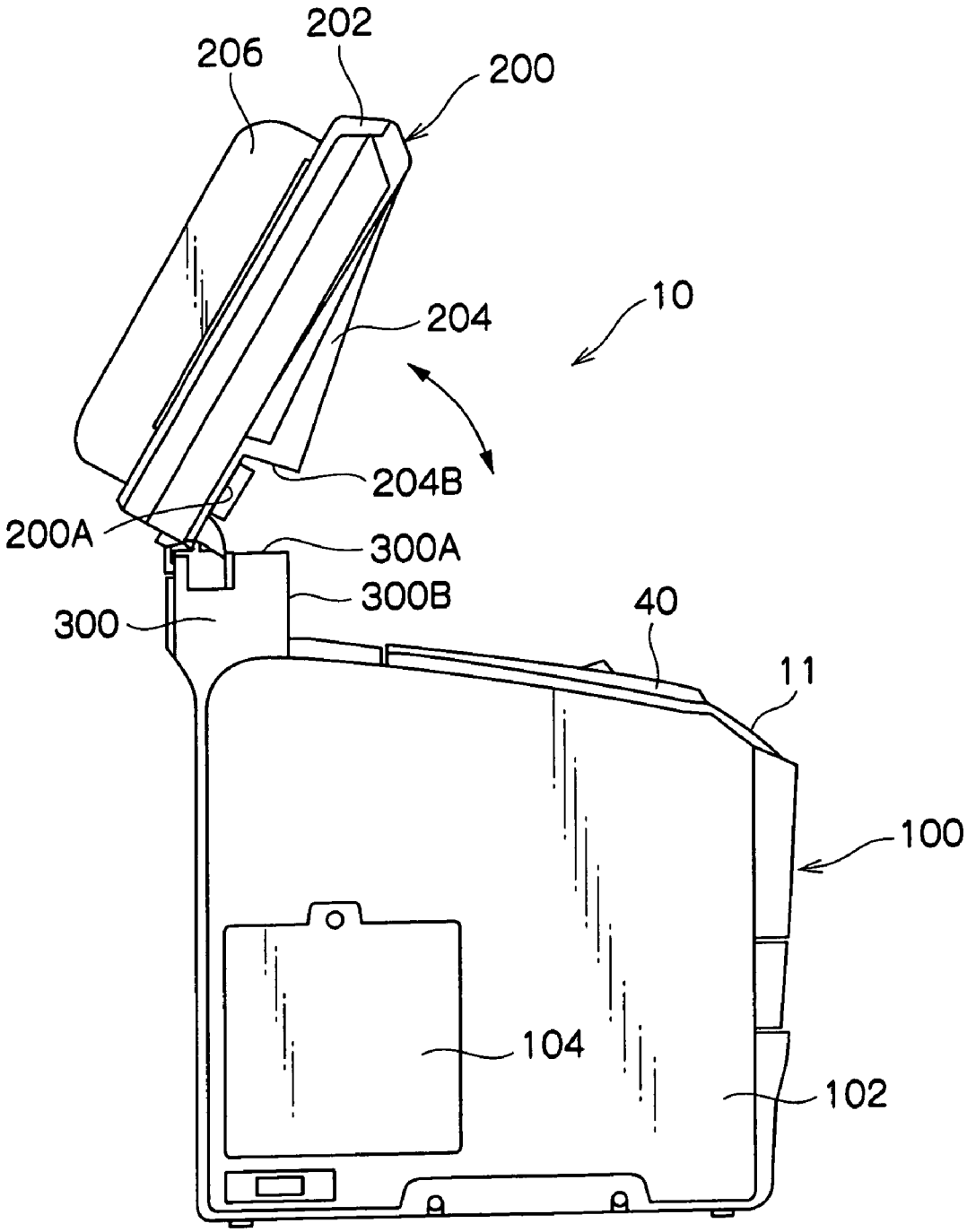
FIG. 5 is a side view of a state in which the image reading section of the digital copier is pivoted and opened.

As shown in FIGS. 4 and 5, the image reading section 200 and projecting portions 220, 222 are connected by hinges 224, 226 (see FIG. 12A), and the image reading section 200 can rotate to a substantially horizontal state (FIG. 4) and an opened state (FIG. 5). As shown in FIG. 5, when the entire image reading section 200 is rotated and opened, the image reading section 200 is withdrawn from above the front surface side of the image forming section 100, and a space is formed above the front surface side of the image forming section 100.

As shown in FIG. 2, hanging-down portions 204, 205, which are each shaped as an upside-down triangle whose side end portion is the base of the triangle, are formed along the side end portions of the image reading section 200.

As shown in FIG. 4, when the image reading section 200 is in its substantially horizontal state (closed state), a top surface 300A of the first supporting pillar portion 300 receives a bottom surface 200A of a corner portion of the image reading section 200, and a side surface 300B of the first supporting pillar portion 300 receives a side surface portion 204B of the hanging-down portion 204. Note that, although not illustrated, at the side surface at the opposite side as well, similarly, a top surface 302A of the second supporting pillar portion 302 receives the bottom surface 200A of the corner portion of the image reading section 200, and a side surface 302B of the second supporting pillar portion 302 receives a side surface portion 205B of the hanging-down portion 205.

Next, a summary of the structure of the image forming section 100, and a summary of the processes of carrying out formation of a color image onto the recording sheet P, will be described.

As shown in FIG. 1, a photosensitive drum 12 is disposed rotatably at the substantial center of the image forming section 100. A rotary-type developing device 50 is disposed at the front surface side (the right side) of the image forming section 100.

The photosensitive drum 12 rotates in the direction of arrow A. After the surface of the photosensitive drum 12 is charged to a predetermined potential by a charging unit 14 which is disposed at the lower side of the photosensitive drum 12, exposure is carried out by a laser beam L exiting from a light scanning device 16 disposed beneath the photosensitive drum, and latent images, which are based on the above-mentioned digital image data of the document read by the image reading section 200, are formed.

The latent images formed on the surface of the photosensitive drum 12 are developed by developing units 52Y, 52M, 52C, 52K of the respective colors of magenta (M), yellow (Y), cyan (C), and black (K), which are disposed along the circumferential direction of the rotary-type developing device 50, such that toner images of predetermined colors are formed. Note that the developing units 52Y, 52M, 52C, 52K have replaceable toner cartridges 54Y, 54M, 54C, 54K, respectively.

The toner images formed on the surface of the photosensitive drum 12 are primarily transferred onto an intermediate transfer belt 30, which is trained over a plurality of rollers 18 and a transfer roller 35 and which rotates in the direction of arrows C. Note that the un-transferred residual toner, which was not primarily transferred and remains on the surface of the photosensitive drum 12, is removed by a photosensitive drum cleaning device 20.

The rotary-type developing device 50 rotates in the direction of arrow B around a rotation shaft K, and developing rollers 56Y, 56M, 56C, 56K of the developing units 52Y, 52M, 52C, 52K of the colors corresponding to the colors of the image to be formed, successively move to a developing position G and carry out development of the respective colors.

The respective processes of charging, exposure, developing, primary transfer, and photosensitive drum cleaning are repeated a predetermined number of times, in accordance with the colors of the image to be formed. In this way, toner images of the respective colors are multiple-transferred and superposed onto the intermediate transfer belt 30, and form a full-color image.

On the other hand, a sheet feeding cassette 22, in which the recording sheets P are accommodated, is disposed at the lower portion of the image forming section 100.

The recording sheet P is fed-out by a sheet feeding roller 24, and is sent to a secondary transfer position T at a predetermined time by register rollers 33. The full-color toner image of the intermediate transfer belt 30 is secondarily transferred onto the recording sheet P all at once by a secondary transfer roller 32 and a transfer roller 35. The un-transferred residual toner of the intermediate transfer belt 30, which was not secondarily transferred and remains, is removed by a transfer belt cleaning device 37.

The recording sheet P, onto which the full-color toner image has been transferred, is sent to a fixing unit 36 which is disposed at the upper portion of the rear side. The fixing unit 36 fixes the full-color toner image onto the recording sheet P by heat and pressure. The recording sheet P, onto which the full-color toner image has been fixed, is discharged-out onto the sheet discharge tray 40 at the top portion of the image forming section 100.

Figure 11:
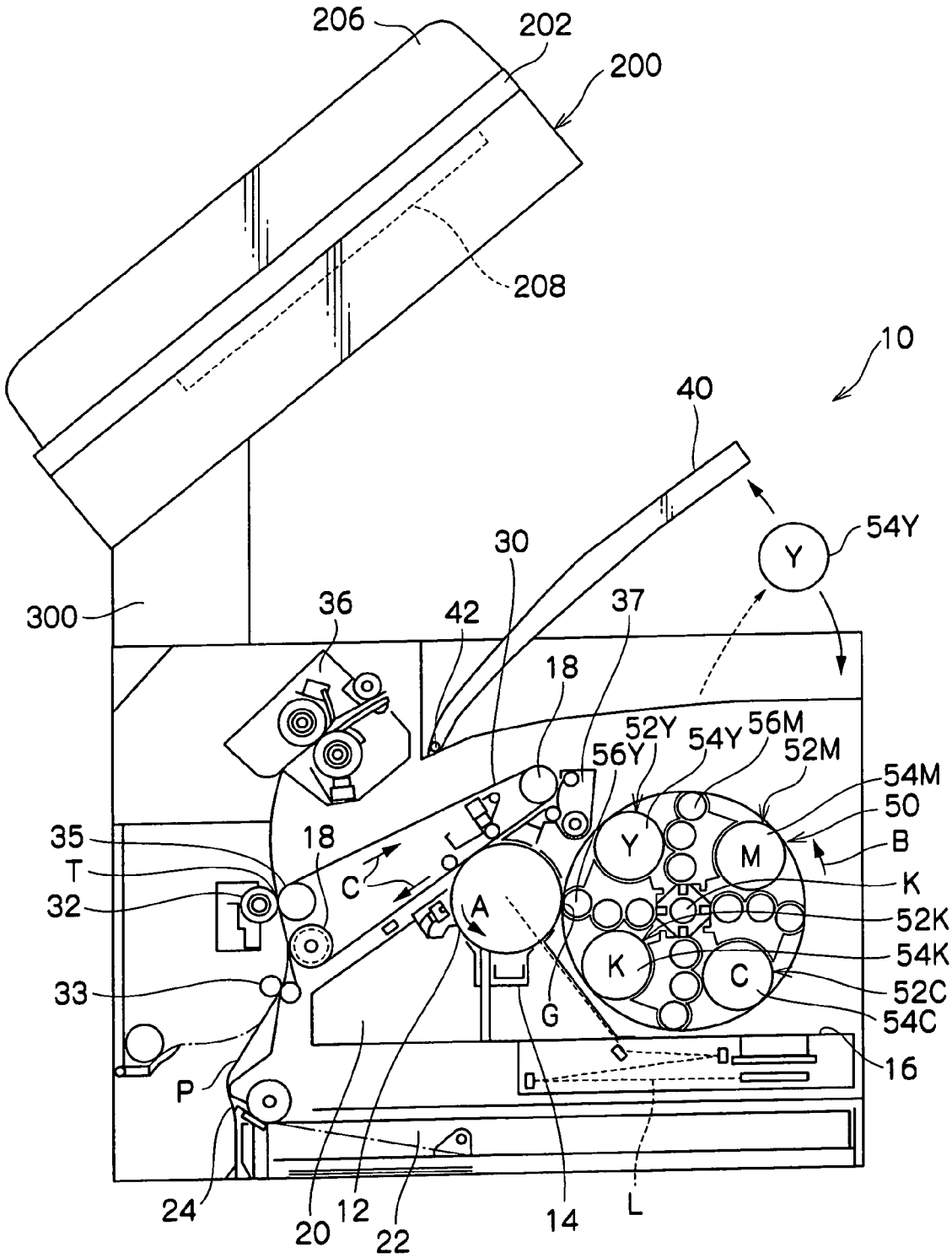
FIG. 11 is a drawing schematically showing a state in which, when the image reading section of the digital copier is pivoted and opened, a sheet discharge tray is opened and a toner cartridge is replaced.

When the entire image reading section 200 is rotated and withdrawn from above the front surface side of the image forming section 100 as shown in FIG. 5, a space is formed above the front surface side of the image forming section 100. Then, as shown in FIG. 11, the sheet discharge tray 40 is rotated around a rotation shaft 42 at the rear side end portion thereof and opened, such that the toner cartridge 54 can be replaced. Note that FIG. 11 illustrates replacement of the toner cartridge 54Y, but the other toner cartridges 54M, 54C, 54K can be replaced by rotating the rotary-type developing device 50 and moving the respective developing units 52 to the position at which replacement is possible.

Figure 6:
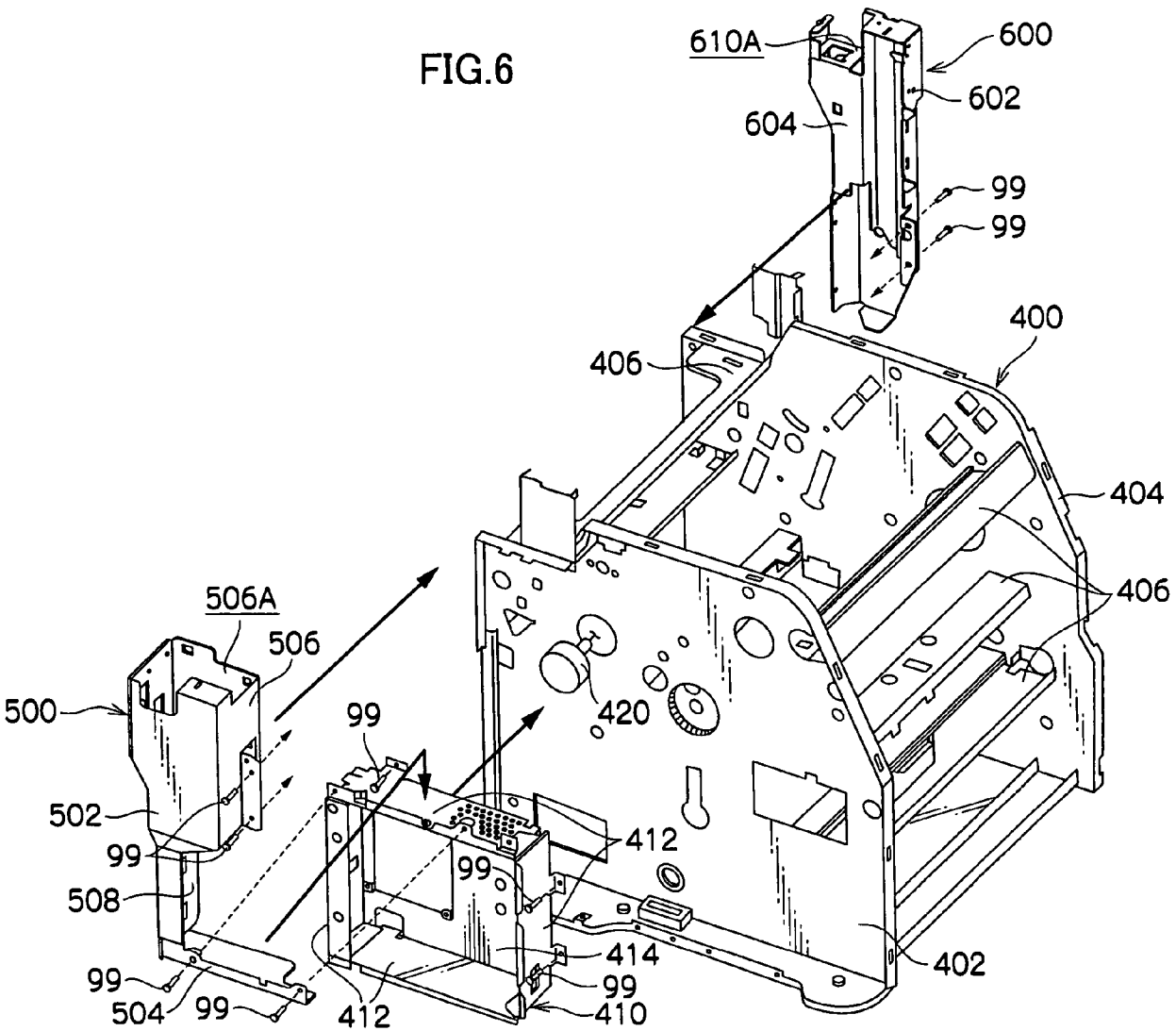
FIG. 6 is a perspective view showing a frame structure of the digital copier.
Figure 7:
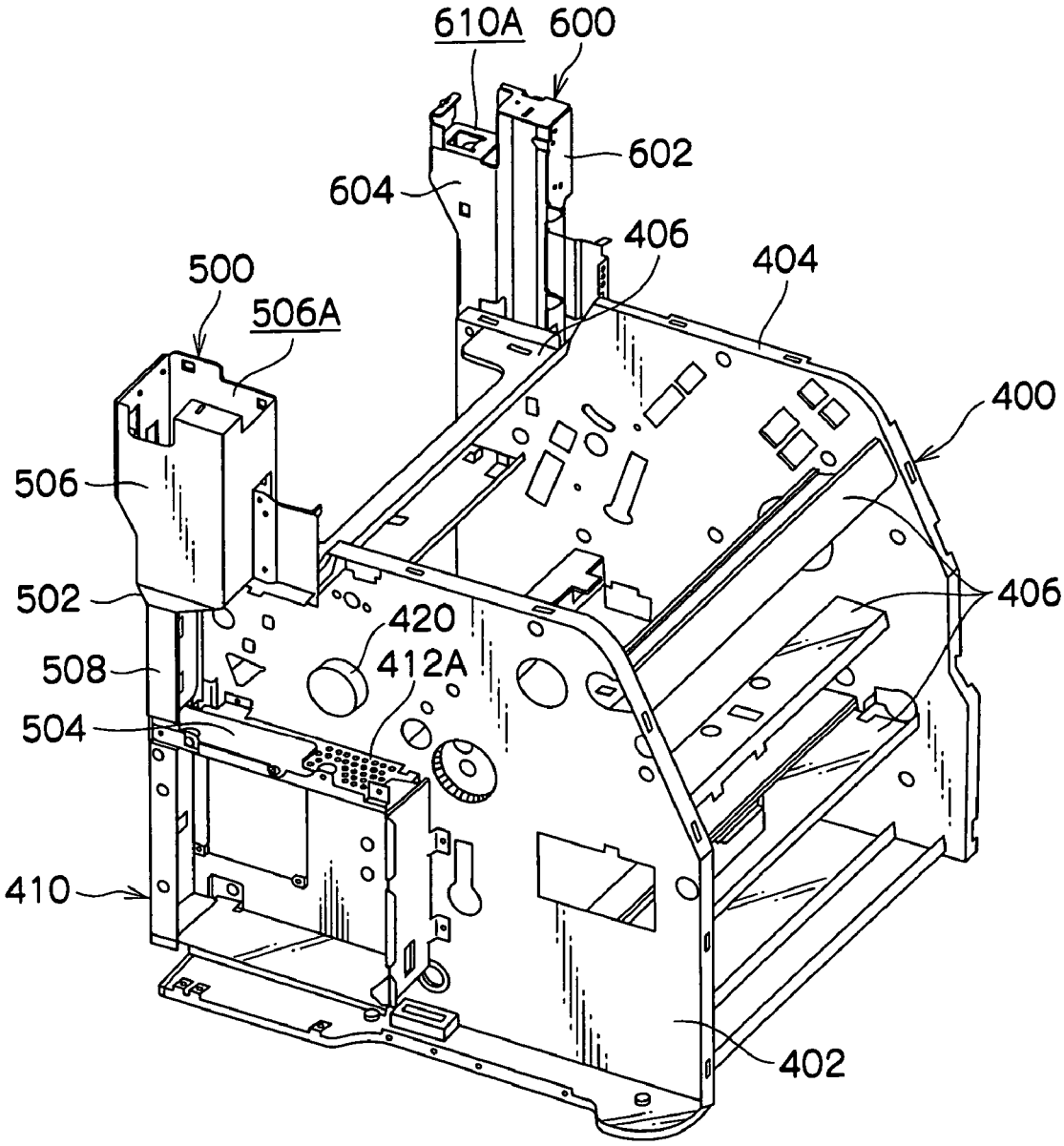
FIG. 7 is a drawing showing the frame structure of the digital copier.
Figure 8:
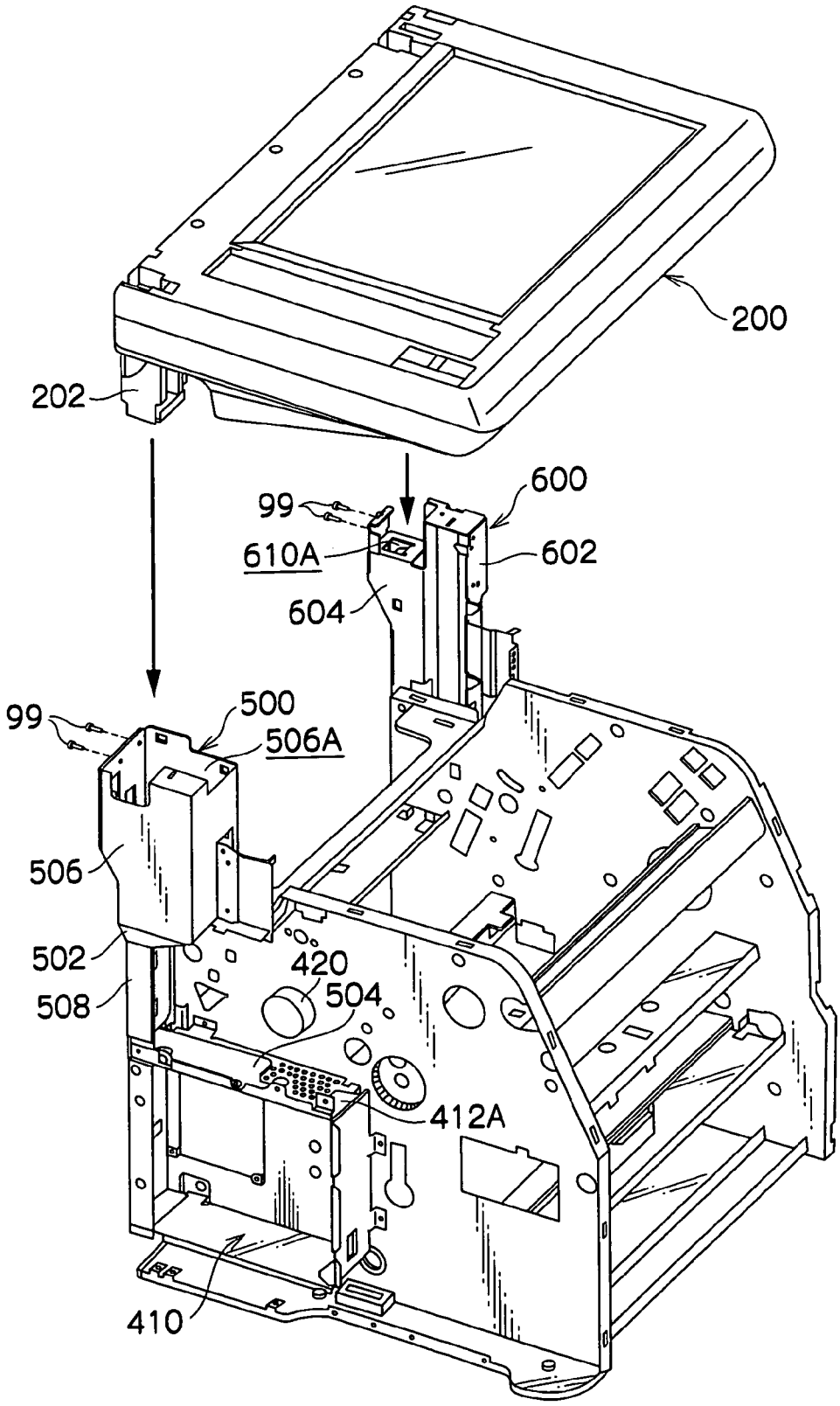
FIG. 8 is a drawing in which the image reading section is mounted to a first supporting pillar and a second supporting pillar.

Next, the supporting structure (frame structure) of the image reading section 200 of the digital copier 10 will be described. FIGS. 6, 7, 8 and the like are drawings showing a state in which the various types of covers of the image forming section 100 have been removed.

Note that, in the following explanation, description is given of fixing by screws 99. In the drawings corresponding to these descriptions, in order to avoid the drawings from becoming complex and difficult to view, not all of the screws 99 (and screw holes) are shown. Only several, representative screws 99 (and screw holes) are shown, and illustration of the other screws 99 is omitted.

As shown in FIGS. 6 and 7, a housing 400 of the image forming section 100 is structured by side plates 402, 404 which are metal plates which oppose one another, and a plurality of bridging plates 406 which span between the side plates 402, 404 which oppose one another.

A box-shaped box portion 410, which is structured by four side portions 412 and a floor surface portion 414, is fixed to the one side plate 402. The floor surface portion 414 of the box portion 410 and the side plate 402 are fixed by the screws 99 so as to be superposed one on the other. Accordingly, the side portions 412 stand erect from the side plate 402. A power source circuit board (not illustrated) is mounted within the box portion 410. By removing a power source cover 104, which can be removed from a housing cover 102 shown in FIG. 4 that covers the side plate 402, the operators of the digital copier 10 can easily replace the power source circuit board.

As shown in FIGS. 6 and 7, a driving motor 420 is fixed above the box portion 410. A gear mechanism (not shown), which is formed by plural gears and to which driving force is transferred by the driving motor 420, is fixed to the reverse side of the side plate 402 (at the interior of the housing 400).

A first supporting pillar 500, which is formed by plural metal plates being bent and joined together, is fixed to the side plate 402. The first supporting pillar 500 is structured from a first supporting portion 502 and a second supporting portion 504, which extends in the horizontal direction (the same direction as the image reading section 20) from the lower portion of the first supporting portion 502, and the first supporting pillar 500 is formed substantially in the shape of the letter L overall.

The first supporting portion 502 is structured by a first box portion 506 which is shaped as a hollow, rectangular column whose top portion is open, and a second box portion 508 which is provided at the lower portion of the first box portion 506 and is shaped as a hollow, rectangular column which is thinner than the first box portion 506. The longitudinal directions (axial directions) of both the first box portion 506 and the second box portion 508 are the vertical direction. The second supporting portion 504 is plate-shaped, and extends in the horizontal direction from the lower portion of the second box portion 508.

The first supporting portion 502 is fixed to the side plate 402 by screws 99. The second supporting portion 504 is superposed on a side portion 412A, which is the top surface of the box portion 410, and is fixed thereto by the screws 99. Further, the second supporting portion 504 is fixed so as to be kept clear so as to not interfere with the driving motor 420.

A second supporting pillar 600 is fixed to the other side plate 404 by the screws 99. Note that the box portion 410 and the driving motor 420 are not fixed to the side plate 404, as they are to the one side plate 402. Therefore, the second supporting pillar 600 extends straight to the lower portion of the side plate 404.

Figures 9A, 9B, 9C:
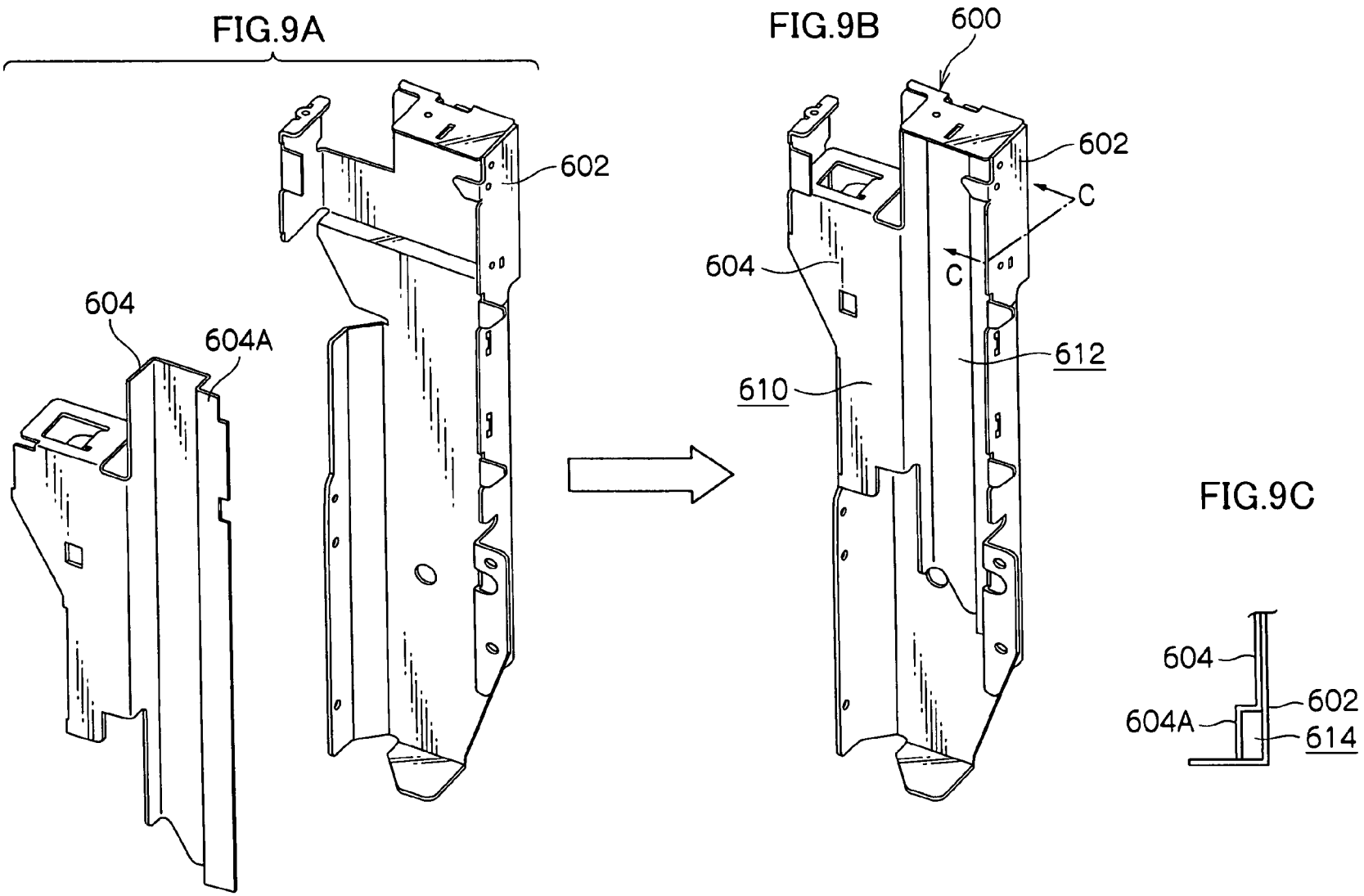
FIG. 9A is a drawing showing a state before two metal plates of the second supporting pillar are joined.
FIG. 9B is a drawing showing a state after the two metal plates of the second supporting pillar have been joined.
FIG. 9C is a cross-sectional view taken along section C-C of FIG. 9B.

As shown in FIGS. 9A through 9C, the second supporting pillar 600 is shaped as a hollow, substantially rectangular pillar by a metal plate 602 and a metal plate 604, which have been subjected to bending processing, being superposed and fixed together by the screws 99. The upper portion of the second supporting pillar 600 is divided into two chambers 610, 612. Further, as shown in FIG. 9C, an end side portion 604A of the one metal plate 604 is bent and, together with the other metal plate 602, forms a rectangular pillar portion 614 which is shaped as a hollow, rectangular pillar. Note that the longitudinal directions (axial direction) of both the second supporting pillar 600 and the rectangular pillar portion 614 are the vertical direction.

Figure 10:
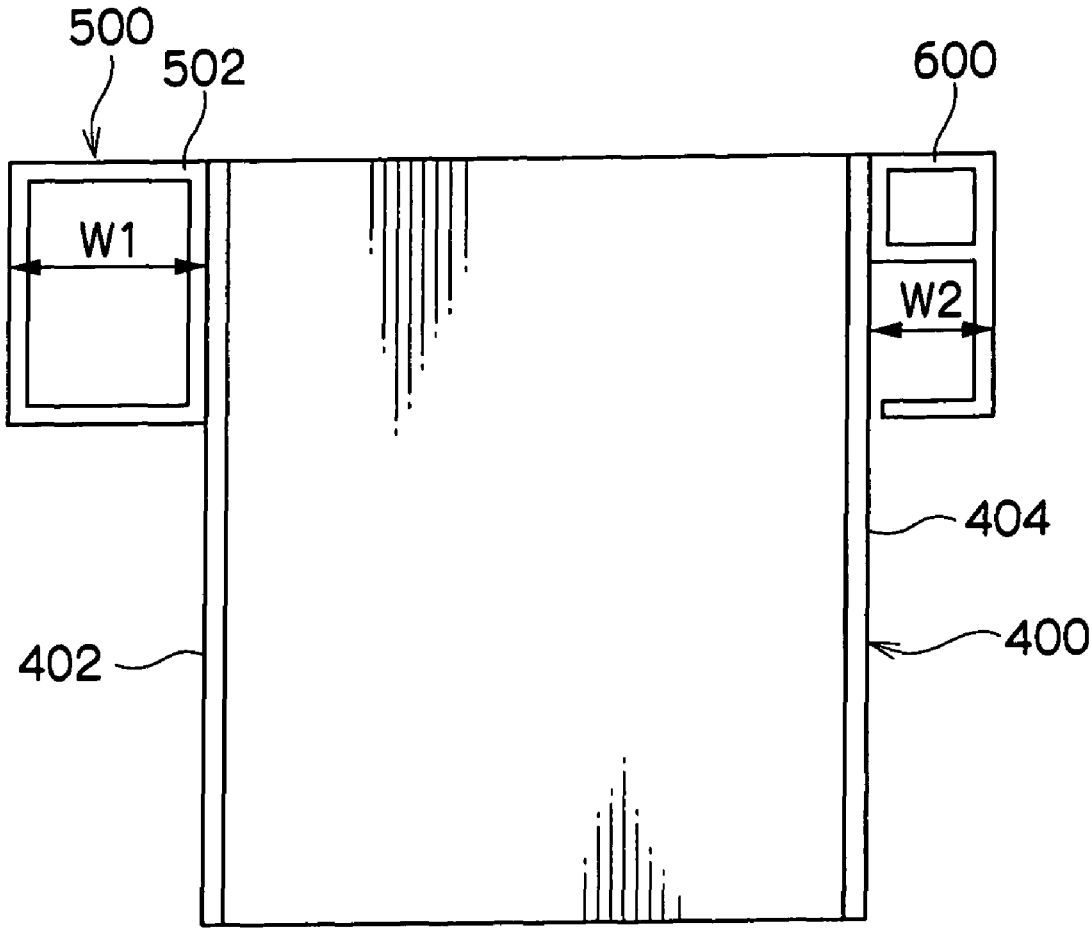
FIG. 10 is a schematic drawing showing differences in the sizes of the cross-sections of a first supporting portion of the first supporting pillar, and the second supporting pillar.

As shown in FIG. 10, the horizontal cross-section of the first supporting portion 502 of the first supporting pillar 500 is larger (wider) than the horizontal cross-section of the second supporting pillar 600. The widths thereof in the front-back direction (the top-bottom direction in FIG. 10) are substantially the same, but the first supporting portion 502 is wider in the left-right direction. In the present embodiment, a width W1 of the first supporting portion 502 of the first supporting pillar 500 is about twice a width W2 of the second supporting pillar 600.

Figure 12A:
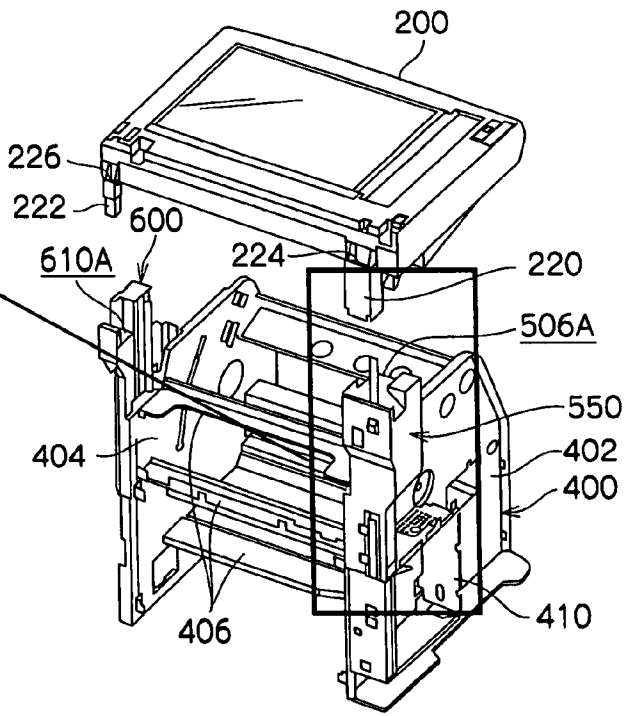
FIG. 12A is a drawing, as seen obliquely from the rear, showing a state in which the image reading section is mounted to the first supporting pillar and the second supporting pillar.

As shown in FIGS. 8 and 12A, the two projecting portions 220, 222 (see FIG. 12A), which project downwardly from the corner portions of the rear side of the image reading section 200, are inserted-in from an opening 506A at the top portion of the first supporting pillar 500 and an opening 610A at the top portion of the second supporting pillar 600, and are fit in the first box portion 506 and the first chamber 610, and are fixed by the screws 99. Accordingly, the first supporting pillar 500 and the second supporting pillar 600 support the image reading section 200 in a cantilevered state.

The image reading section 200 is formed to be strong in order to support the document stand 208, the scanning driving mechanism 212, the automatic document feed device 206 (see FIG. 2), and the like which are heavy. Further, at the interior of the image reading section 200, reinforcing members such as beams or metal plates or the like span between the two projecting portions 220, 222 (see FIG. 12A) (i.e., between the first supporting pillar 500 and the second supporting pillar 600). Accordingly, the image reading section 200 does not bend-over even when supported in a cantilevered state in this way by the first supporting pillar 500 and the second supporting pillar 600 at the two corner portions.

As shown in FIGS. 3 and 4, the side surface portions between the image forming section 100 and the image reading section 200 are open, except for at the hanging-down portions 204, 205, the first supporting pillar portion 300, and the second supporting pillar portion 302. (This is portion R encircled by the dotted line in FIGS. 3 and 4.) Accordingly, the structure is excellent in terms of design.

Further, as shown in FIGS. 2 and 3, the aforementioned automatic document feed device 206 and scanning driving mechanism 212 which scans the reading bar 210 are both disposed at the side plate 402 side. Accordingly, as shown in FIG. 3, when viewed from the front surface, a center of gravity position Y2 of the image reading section 200 is further toward the side plate 402 than a central line Y1.

As described above, the image reading section 200 rotates and opens as shown in FIGS. 4 and 5 by the hinges 224, 226 (see FIG. 12A).

Figure 12B:
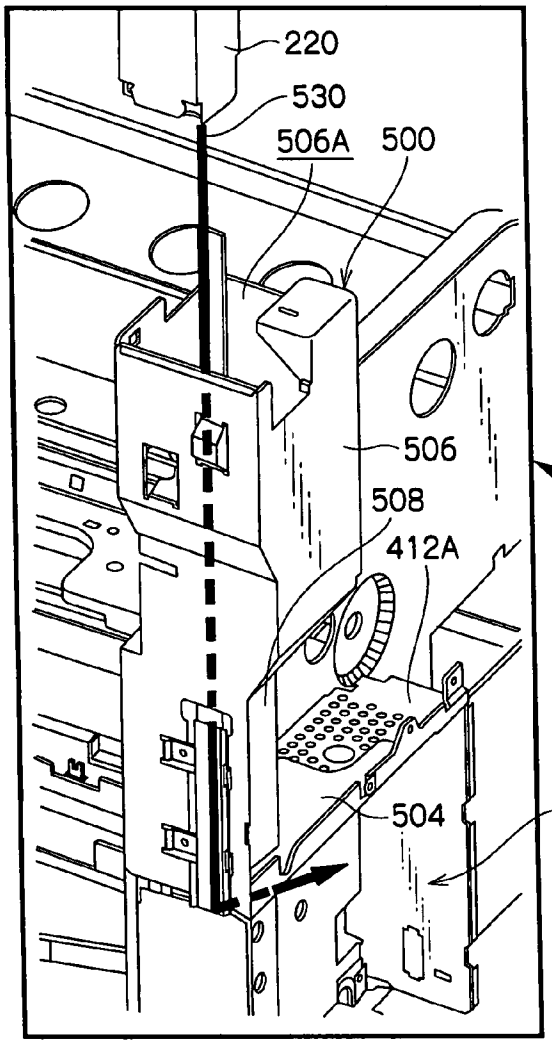
FIG. 12B is an enlarged view of the outlined portion of FIG. 12A.

As shown in FIGS. 12A and 12B, an electric wire 530, which connects the image reading section 200 and the power source circuit board (not shown) mounted to the aforementioned box portion 410, passes through the interior of the first supporting pillar 500.

Figure 13A:
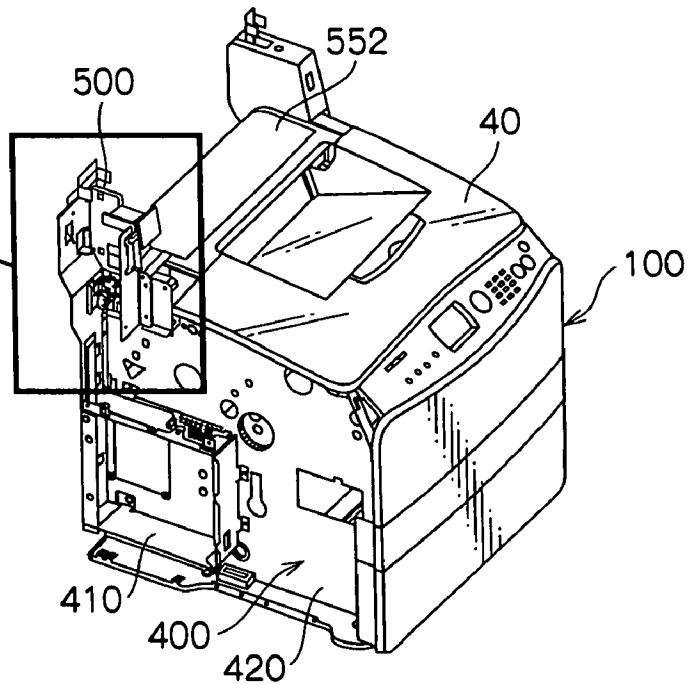
FIG. 13A is a drawing showing a state in which the image reading section is not mounted.
Figure 13B:
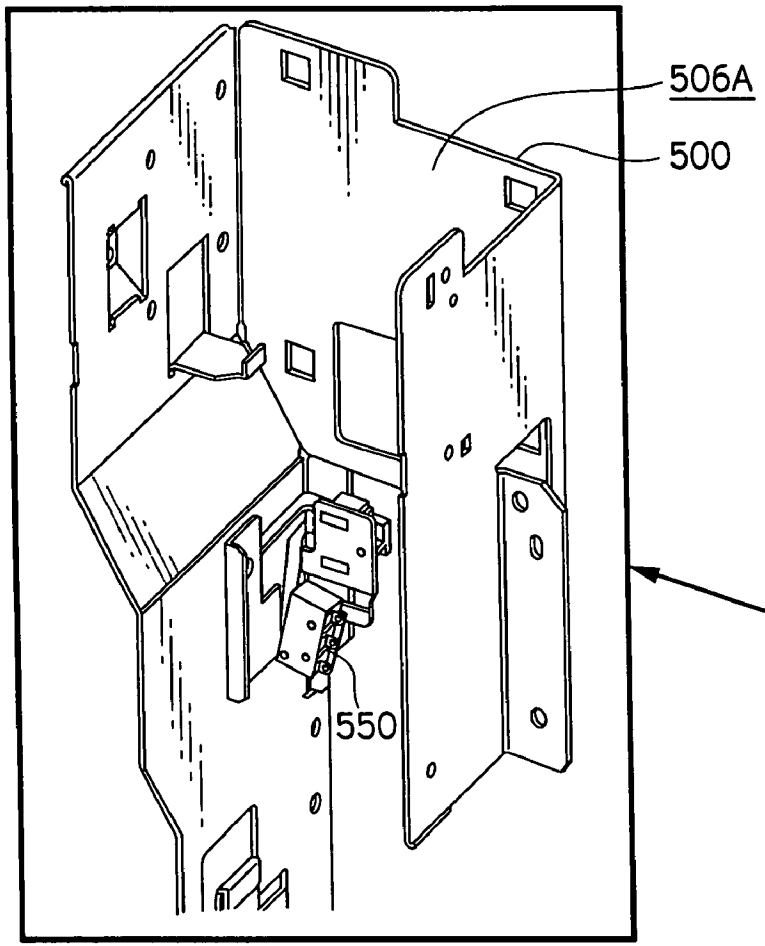
FIG. 13B is an enlarged view of the quadrilateral portion of FIG. 13A.

Further, as shown in FIGS. 13A and 13B, a sensing switch 550 is mounted to the interior of the first supporting pillar 500. The sensing switch 550 senses the opening and closing of an opening/closing cover 552 provided at the outer side of the fixing unit 36 (see FIG. 1) which is disposed at the upper portion of the rear side of the image forming section 100.

Figure 14:
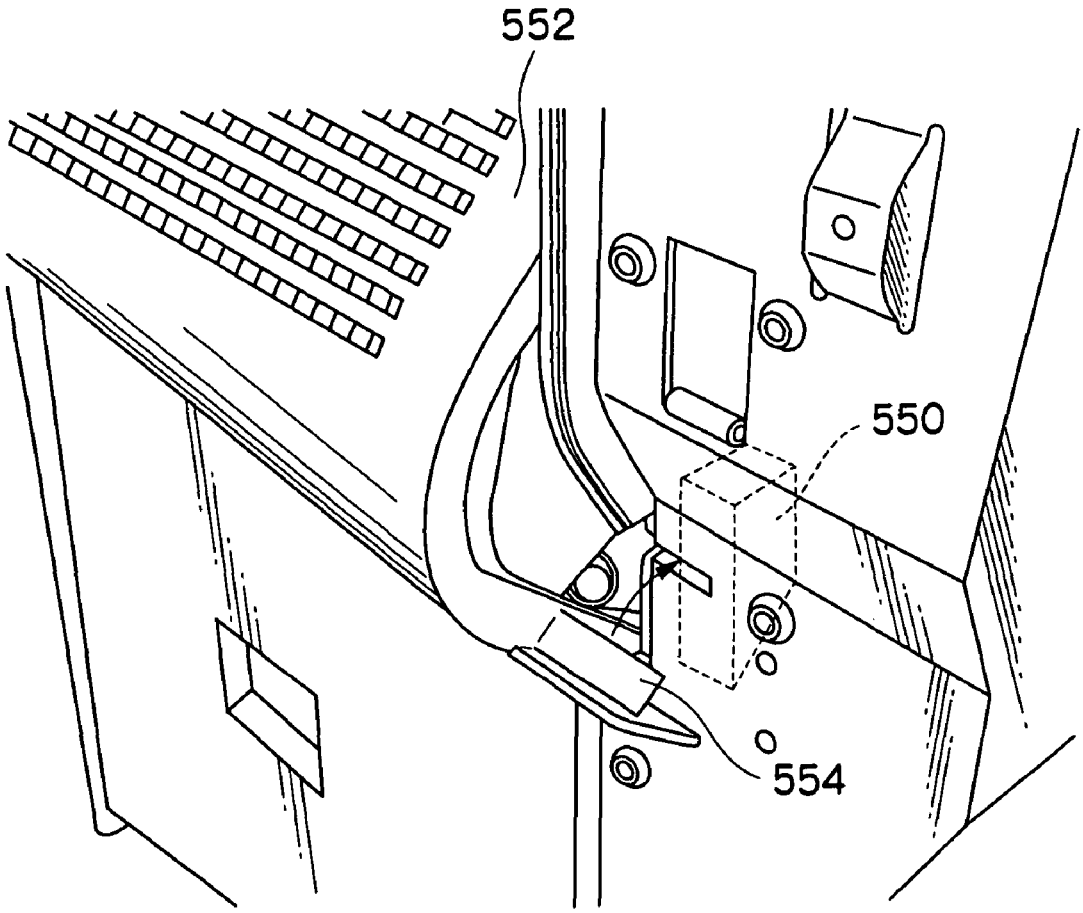
FIG. 14 is a drawing showing a state in which an opening/closing cover of a fixing unit is opened.

Concretely, as shown in FIG. 14, sensing is carried out by a projecting portion 554, which is formed at the opening/closing cover 552, turning the sensing switch 550 on and off as the opening/closing cover 552 is opened and closed. Note that the power source is off when the opening/closing cover 552 is open (the state shown in FIG. 14).

Next, operation of the present embodiment will be described.

Figure 15:
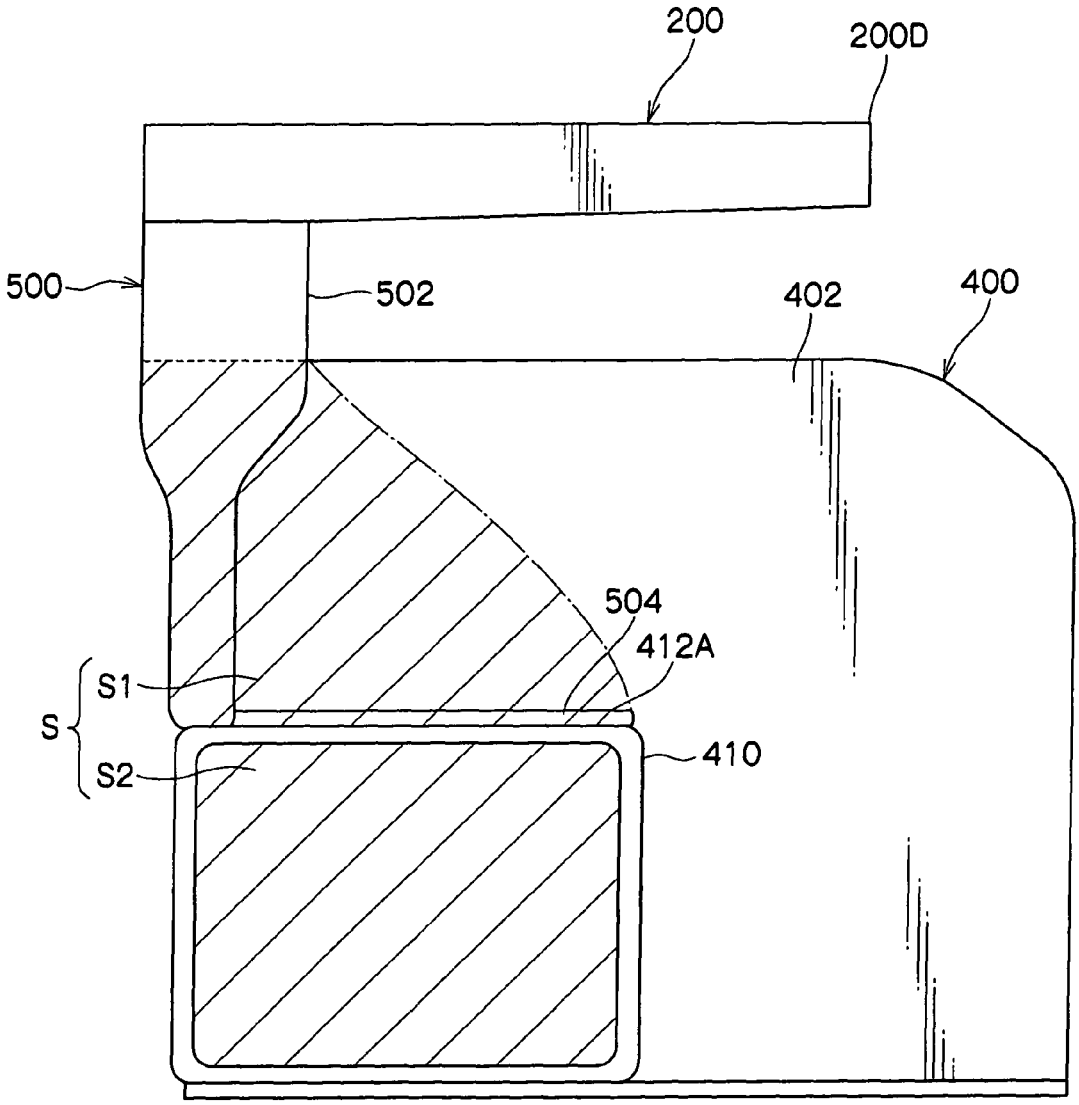
FIG. 15 is a side view schematically showing the frame structure of the digital copier.

As shown schematically in FIG. 15, the first supporting portion 502 is fixed to the side plate 402, and the second supporting portion 504, which extends substantially in the horizontal direction, is fixed to the box portion 410 which is fixed to the side plate 402. Accordingly, the box portion 410, which is integral with the first supporting pillar 500, also supports the image reading section 200. (that is, the box portion 410 is also a structural part which supports the image reading section 200.)

Accordingly, the image reading section 200 is supported at a wide region S, which is combination of a triangular region S1 structured by the first supporting portion 502 and the second supporting portion 504 and a rectangular region S2 of the box portion 410. Therefore, even though the first supporting pillar 500 is fixed to the side plate 402, it is difficult for warping to arise at the side plate 402. Accordingly, even though the first supporting pillar 500 is fixed to the side plate 402, deterioration in the quality of the image caused by the warping of the housing 400 of the image forming section 100 does not occur.

Further, as shown in FIG. 2, because the first supporting pillar 500 supports a rear side corner portion of the image reading section 200, force of the image reading section 200 falling toward the front surface side is applied around this corner portion. However, as shown in FIG. 15, the side portion 412A, which is the top surface of the box portion 410, receives the second supporting portion 504 which extends in the horizontal direction. Accordingly, force of the first supporting pillar 500 falling toward the front surface side (toward the right side in FIG. 15), i.e., the force of the image reading section 200 falling toward the front surface side, can be reliably countered. Further, even if force which downwardly pushes a front surface side end portion 200D of the image reading section 200 is applied, the first supporting pillar 500 does not collapse easily. Moreover, as described above, it is difficult for the side plate 402 to warp.

Because the first supporting pillar 500 is structured so as to be securely fixed to the side plate 402 in this way, there is no need for a beam which spans between the first supporting pillar 500 and the second supporting pillar 600.

The first supporting pillar 500 is securely fixed to the side plate 402, and supports almost all of the load of the image reading section 200. Therefore, the second supporting pillar 600 does not have to be fixed as securely as the first supporting pillar 500. Accordingly, problems do not arise even if the second supporting pillar 600 does not have the second supporting portion 504 as does the first supporting pillar 500 as shown in FIG. 6. Namely, because the second supporting pillar 600 can be formed in an arbitrary shape, there are many degrees of freedom in design.

Both the first supporting portion 502 of the first supporting pillar 500 and the second supporting pillar 600 are hollow tubular shapes (rectangular column shapes) whose axial directions are the vertical direction. Accordingly, they can more strongly support the load of the image reading section 200.

As shown in FIG. 3, the center of gravity position Y2 of the image reading section 200 is offset toward the side plate 402 side. Further, as shown in FIG. 7, the driving motor 420 which generates vibrations is mounted to the side plate 402. Accordingly, such load and vibrations can be handled by, as shown in FIG. 10, fixing the first supporting pillar 500 to the side plate 402 and making the cross-section of the first supporting portion 502 large.

The load and vibrations which the second supporting pillar 600 receives are less than those that the first supporting pillar 500 receives. Further, as shown in FIG. 9C, the strength is improved by bending the end side portion 604A of the one metal plate 604, and forming the rectangular pillar portion 614, which is shaped as a hollow, rectangular pillar, by the end side portion 604A and the other metal plate 602. Therefore, problems do not arise even if the cross-section is made to be thin. Namely, there are many degrees of freedom in design.

The first supporting pillar 500 and the second supporting pillar 600 are fixed by the screws 99 to the side plate 402 of the housing 400 of the image forming section 100. The two projecting portions 220, 222, which project downwardly from the corner portions of the rear side of the image reading section 200, are inserted and fit-in through the opening 506A at the top portion of the first supporting pillar 500 and the opening 610A at the top portion of the second supporting pillar 600, and are fixed by the screws 99. Assembly is therefore easy.

The image reading section 200 is mounted by using the housing 400 of the image forming section 100 as it is. Accordingly, the digital copier 10 can be manufactured at a low cost.

In other words, it is also easy to make the image forming section 100 alone be an independently manufactured product (a printer), without mounting thereto the image reading section 200, the first supporting pillar 500, and the second supporting pillar 600. The image forming section 100 can be easily expanded to the digital copier 10 by mounting the image reading section 200 to the image forming section 100 as in the present embodiment.

In any case, because fixing is carried out by the screws 99, the respective structures can be easily removed (separated), which is well-suited to times of carrying out repair and maintenance.

Further, as shown in FIGS. 12A and 12B, the electric wire 530 passes through the interior of the first supporting pillar 500, and as shown in FIGS. 13A and 13B, the sensing switch 550 is mounted at the interior of the first supporting pillar 500. Accordingly, there is no need to separately provide space for the mounting of the sensing switch 550 and the laying of the electric wire 530. Namely, space can be conserved. Moreover, because the electric wire 530 is not exposed, this structure is preferable from the standpoint of appearance as well.

Note that the present invention is not limited to the above-described embodiment.

For example, the present invention is not limited to the structure of the image forming section 100 of the above-described embodiment. An image forming section of another structure which utilizes a known electrophotographic method may be used. Or, an image forming section may be the one which employs an image forming method other than an electrophotographic method, e.g., a known inkjet recording method which carries out image formation by an inkjet recording head in which ink drops are expelled from nozzles.

Further, the second supporting pillar 600 may be structured similarly to the first supporting pillar 500.

What is claimed is:

1. An image forming device having an image reading section which is supported in a cantilevered state with a space between the image reading section and a top surface of an image forming section, the image forming device comprising:

a housing of the image forming section; and a first supporting body fixed to a side surface of the housing and supporting the image reading section, wherein the first supporting body has:

a first supporting portion which has a fixing portion which fixes the first supporting portion to the side surface of the housing and which supports the image reading section; and a second supporting portion extending from the first supporting portion in a same direction as the image reading section which is supported in the cantilevered state, and a receiving portion, which fixes the second supporting portion, and is provided at the side surface of the housing.

2. The image forming device of claim 1, wherein the receiving portion is a frame which is fixed to the side surface of the housing and stands erect from the side surface, and the second supporting portion is fixed to the frame.

3. The image forming device of claim 2, wherein the first supporting portion, the second supporting portion, and the frame are structured so as to be integral and support the image reading section.

4. The image forming device of claim 1, wherein the first supporting portion of the first supporting body is shaped as a hollow tube whose axial direction is a vertical direction.

5. The image forming device of claim 4, wherein:

the side surface that the first supporting body is fixed to and another side surface form a pair of side surfaces that are provided so as to oppose one another, the first supporting body and a second supporting body are fixed to the side surfaces respectively, and sizes of horizontal cross-sections of the first supporting portion of the first supporting body and the second supporting body, which are shaped as hollow tubes, are different.

6. The image forming device of claim 1, wherein:

a pair of side surfaces are provided so as to oppose one another, the first supporting body is fixed to one of the side surfaces, and a second supporting body, whose shape is different than a shape of the first supporting body and which supports the image reading section, is fixed to another of the side surfaces.

7. The image forming device of claim 6, wherein the second supporting body is shaped as a hollow tube whose axial direction is a vertical direction.

8. The image forming device of claim 7, wherein:

the first supporting portion of the first supporting body is shaped as a hollow tube whose axial direction is the vertical direction, and sizes of a horizontal cross-section of the first supporting portion, which is shaped as a hollow tube, of the first supporting body, and a horizontal cross-section of the second supporting body, which is shaped as a hollow tube, are different.

9. The image forming device of claim 6, wherein, among the pair of side surfaces which oppose one another, the first supporting body is fixed to the side surface which is nearer to a center of gravity of the image reading section.

10. The image forming device of claim 9, wherein a horizontal cross-section of the first supporting portion of the first supporting body is larger than a horizontal cross-section of the second supporting body.

11. The image forming device of claim 6, wherein:

a driving mechanism is mounted to either one of the pair of side surfaces which oppose one another, and the first supporting body is fixed to the one side surface to which the driving mechanism is mounted.

12. The image forming device of claim 1, wherein an electric wire, which electrically connects the image reading section and the image forming section, is attached to either one of or to both of the first supporting body and a second supporting body.

13. The image forming device of claim 1, wherein an interlocking mechanism of the image forming section is attached to either one of or to both of the first supporting body and a second supporting body.

14. The image forming device of claim 1, wherein either one of or both of a second supporting body and the first supporting portion of the first supporting body is structured by a plurality of metal plates being superposed together, and the metal plates are bent and form a hollow rectangular pillar portion whose axial direction is a vertical direction.

15. The image forming device of claim 1, wherein the image forming section is disposed above a sheet feeding cassette.

16. The image forming device of claim 1, wherein the side surface of the housing extends in the same direction as the image reading section.

17. The image forming device of claim 1, wherein the fixing portion of the first supporting portion is disposed above a sheet feeding cassette.

18. The image forming device of claim 1, wherein the fixing portion fixes the first supporting portion vertically along the side surface of the housing.

* * * * *